US008770715B2

(12) United States Patent
Kawai et al.

(10) Patent No.: US 8,770,715 B2
(45) Date of Patent: Jul. 8, 2014

(54) INK-JET PRINTER

(75) Inventors: Takamitsu Kawai, Obu (JP); Takashi Ohama, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 341 days.

(21) Appl. No.: 11/744,806

(22) Filed: May 4, 2007

(65) Prior Publication Data

US 2007/0263051 A1 Nov. 15, 2007

(30) Foreign Application Priority Data

May 9, 2006 (JP) ..... 2006-130485

(51) Int. Cl.
*B41J 2/165* (2006.01)

(52) U.S. Cl.
USPC ..... 347/36

(58) Field of Classification Search
USPC ..... 347/36
See application file for complete search history.

(56) References Cited

U.S. PATENT DOCUMENTS

| | | | | |
|---|---|---|---|---|
| 5,680,162 | A * | 10/1997 | Taylor et al. | 347/35 |
| 5,997,128 | A * | 12/1999 | Lou et al. | 347/33 |
| 6,328,414 | B1 * | 12/2001 | Yoshino | 347/36 |
| 6,357,853 | B1 * | 3/2002 | Askren et al. | 347/36 |
| 6,364,449 | B1 * | 4/2002 | Takahashi et al. | 347/30 |
| 6,619,783 | B2 | 9/2003 | Kanaya et al. | |
| 6,629,750 | B2 | 10/2003 | Ciordia | |
| 6,742,863 | B2 | 6/2004 | Takahashi | |
| 6,805,427 | B2 | 10/2004 | Hosono | |
| 6,910,757 | B2 | 6/2005 | Kanamitsu et al. | |
| 6,932,456 | B2 | 8/2005 | Kanaya et al. | |
| 7,011,389 | B2 * | 3/2006 | Edamura et al. | 347/36 |
| 2004/0051755 | A1 | 3/2004 | Kanamitsu et al. | |
| 2005/0062794 | A1 * | 3/2005 | Kanamitsu et al. | 347/31 |
| 2006/0170749 | A1 * | 8/2006 | Watanabe | 347/104 |

FOREIGN PATENT DOCUMENTS

| | | | |
|---|---|---|---|
| JP | 2000-153621 | A | 6/2000 |
| JP | 2000-238288 | A | 7/2000 |
| JP | 2001-088324 | A | 4/2001 |
| JP | 2002-086762 | A | 3/2002 |
| JP | 2002-307727 | A | 10/2002 |

(Continued)

OTHER PUBLICATIONS

Japan Patent Office, Notification of Reasons for Refusal for Japanese Patent Application No. 2006-130485 (counterpart to above-captioned patent application), dispatched Apr. 5, 2011.

*Primary Examiner* — Alejandro Valencia
(74) *Attorney, Agent, or Firm* — Baker Botts L.L.P.

(57) ABSTRACT

An ink-jet printer including: (i) a recording head which has an outer surface and includes at least one nozzle opening in the outer surface; (ii) a carriage which carries the recording head and which is reciprocateable in a main scanning direction; and (iii) a waste-ink retaining device which retains a waste ink forcedly ejected from the at least one nozzle of the recording head when a flushing operation is performed by the recording head. The waste-ink retaining device includes an ink receiving portion which is provided below a flushing position to which the recording head is moved to perform the flushing operation, and which receives the waste ink ejected by the recording head, and a first ink retaining portion which receives the waste ink from the ink receiving portion and retains the waste ink and which extends upward such that a top end thereof is positioned higher than a height position of the ink receiving portion.

2 Claims, 13 Drawing Sheets

(56) References Cited

FOREIGN PATENT DOCUMENTS

| | | | |
|---|---|---|---|
| JP | 2002-326376 | A | 11/2002 |
| JP | 2003-039754 | A | 2/2003 |
| JP | 2003-072111 | A | 3/2003 |
| JP | 2003-080739 | A | 3/2003 |
| JP | 2003-231277 | A | 8/2003 |
| JP | 2003-266741 | A | 9/2003 |
| JP | 2003-320688 | A | 11/2003 |
| JP | 2003-320690 | A | 11/2003 |
| JP | 2004-009700 | A | 1/2004 |
| JP | 2004-042444 | A | 2/2004 |
| JP | 2004-174766 | A | 6/2004 |
| JP | 2004-230806 | A | 8/2004 |
| JP | 2005-271588 | A | 10/2005 |

* cited by examiner

INK-JET PRINTER

The present application is based on Japanese Patent Application No. 2006-130485 filed on May 9, 2006, the contents of which are incorporated herein by reference.

BACKGROUND OF THE INVENTION

1. Field of the Invention

The present invention relates in general to an ink-jet printer including a carriage which carries a recording head and which is reciprocateable in a main scanning direction. In particular, the present invention relates to an ink-jet printer including a waste-ink retaining device which retains a waste ink ejected by the recording head when a flushing operation is performed.

2. Discussion of Related Art

There is known an ink-jet printer including a carriage which carries a recording head and which is reciprocateable in a main scanning direction. The ink-jet printer records an image on a recording medium by ejecting ink to the recording medium by the recording head during the reciprocating movement of the carriage in the main scanning direction. The ink-jet printer also performs a flushing operation, when needed, in which a waste ink is forcedly ejected from a nozzle of the recording head, so that the nozzle of the recording head is prevented from being clogged by the waste ink. Accordingly, the ink-jet printer can enjoy a high quality of image recorded on a recording medium.

Furthermore, Patent Document 1 (JP-A-2004-174766) discloses an ink-jet printer including a waste-ink retaining device (for example, pulp) which is provided below a platen which is opposed to the recording head.

SUMMARY OF THE INVENTION

In recent years, an ink-jet printer is highly needed to be downsized, so that it is difficult for the ink-jet printer to have an enough space below the platen for arranging the waste-ink retaining device. In the above-described technical background, the present invention has been developed. It is therefore an object of the present invention to solve the above-indicated problem and to improve a degree of freedom of provision of a waste-ink retaining device in an ink-jet printer and enjoy a reduced size of the ink-jet printer.

According to the present invention, there is provided an ink-jet printer, comprising: a recording head which has an outer surface and includes at least one nozzle opening in the outer surface; a carriage which carries the recording head and which is reciprocateable in a main scanning direction; and a waste-ink retaining device which retains a waste ink forcedly ejected from the at least one nozzle of the recording head when a flushing operation is performed by the recording head, wherein the waste-ink retaining device includes an ink receiving portion which is provided below a flushing position to which the recording head is moved to perform the flushing operation, and which receives the waste ink ejected by the recording head, and a first ink retaining portion which receives the waste ink from the ink receiving portion and retains the waste ink and which extends upward such that a top end thereof is positioned higher than a height position of the ink receiving portion.

In the present ink-jet printer, the ink receiving portion receives the waste ink ejected from the at least one nozzle of the recording head when the flushing operation is performed by the recording head and the first ink retaining portion receives the waste ink from the ink receiving portion and retains the waste ink. Since the ink retaining portion extends upward such that the top end thereof is positioned higher than the height position of the ink receiving portion a degree of freedom of provision of the waste-ink retaining device (including the ink receiving portion and the ink retaining portion) in the ink-jet printer can be improved, leading to downsizing the ink-jet printer.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings. It is noted that each of terms "vertical direction" and "horizontal direction" used in the following description does not have to be necessarily interpreted to mean a precisely vertical or horizontal direction but may be interpreted to mean a substantially vertical or horizontal direction that is inclined with respect to the precisely vertical or horizontal direction by a certain degree, for example, not larger than 15 degrees.

Figure 1:
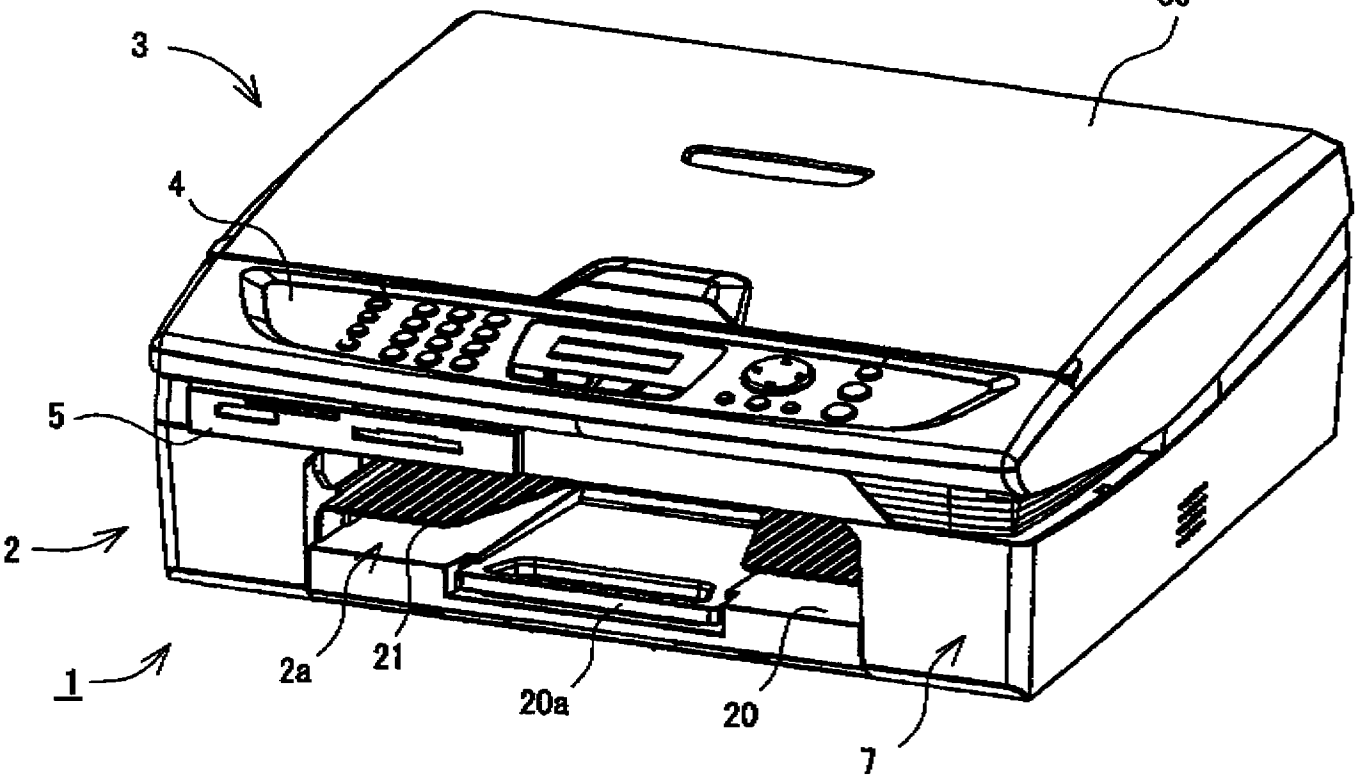
FIG. 1 is a perspective view of a multi-function device (MFD) 1 as a first embodiment of the present invention.

FIG. 1 shows an appearance of a "multi-function device (MFD)" 1 as one embodiment of the present invention. The MFD 1 has a printer function, a scanner function, a copier function and a facsimile-machine function, and includes a printer portion 2 provided in a lower portion thereof, and a scanner portion 3 provided in an upper portion thereof that is integral with the lower portion. In the present embodiment, the multi-function device 1 includes the printer portion 2 as an ink-jet printer to which the present invention is applied. The functions other than the printer function may be omitted, that is, the scanner portion 3 may be omitted. Thus, the present invention may be applied to a single-function printer that has only the printer function and does not have the scanner, copier or facsimile-machine function.

The printer portion 2 of the MFD 1 is mainly connected to an external data-processor device such as a computer, not shown, so that the MFD 1 can record, based on image data supplied from the computer, an image on a recording sheet as a recording medium. Alternatively, the MFD 1 may be connected to a digital camera, so that the MFD 1 may record, based on image data outputted from the digital camera, an image on a recording sheet. Moreover, the MFD 1 may include a memory receiving portion that can receive each of various sorts of memories, such as a memory card, so that the MFD 1 may record, based on image data stored in the each memory, an image on a recording sheet.

Figure 2:
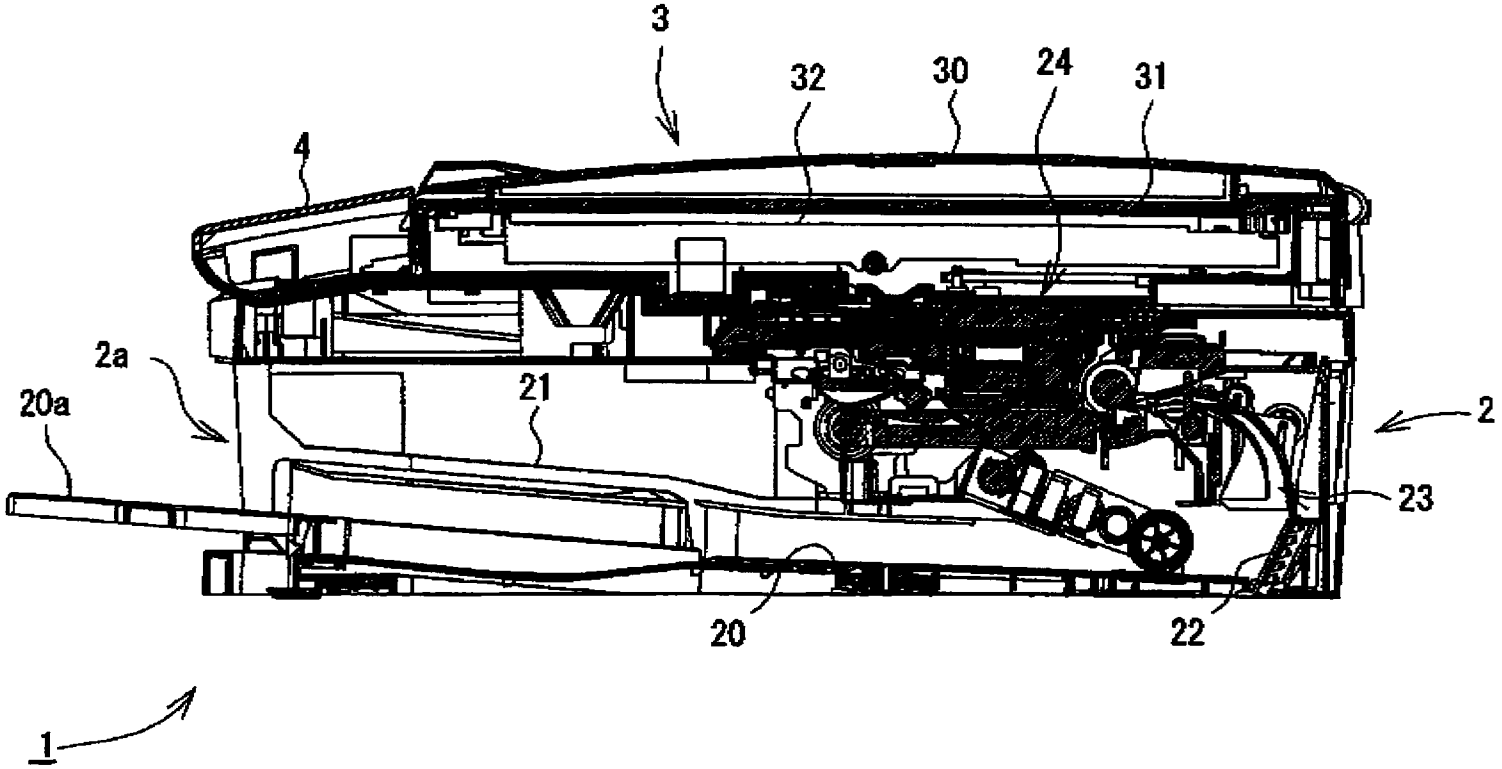
FIG. 2 is a cross-sectional view showing an internal structure of the MFD 1.

As shown in FIG. 1, a width and a length of the MFD 1 are greater than a height thereof. Thus, the MFD 1 has a generally rectangular parallelepiped shape. The printer portion 2 is provided in the lower portion of the MFD 1. The printer portion 2 includes a front opening 2*a* formed in a front surface of the MFD 1, and a sheet-feed tray 20 and a sheet-discharge tray 21 that are exposed through the front opening 2*a* and that have a stacked structure. The sheet-feed tray 20 is for storing the recording sheets as recording media, and can accommodate sheets of various sizes not larger than A4 Size, such as A4 Size, B5 Size, or Postcard Size. As shown in FIG. 2, the sheet-feed tray 20 includes a slide member 20*a* that can be extended, as needed, to increase a sheet-support surface of the tray 20 and that can accommodate sheets of larger sizes such as Legal Size. The recording sheets accommodated by the sheet-feed tray 20 are supplied, one by one, to an image recording portion 24, so that after a desired image is recorded on each recording sheet, the each sheet is discharged onto the sheet-discharge tray 21.

The scanner portion 3, i.e., so-called "flat-bed" scanner is provided in the upper portion of the MFD 1. As shown in FIGS. 1 and 2, the scanner portion 3 includes a cover member 30 as a top plate that can cover an original sheet placed on an upper surface of a platen glass 31. The cover member 30 is pivotable upward and downward so as to be opened and closed. An image sensor 32 is provided below the platen glass 31. The original sheet has an original image to be read by the scanner portion 3. A main scanning direction of the image sensor 32 is a widthwise direction of the MFD 1 (leftward and rightward directions in FIG. 2). The image sensor 32 is reciprocateable in a lengthwise direction of the MFD 1 (a direction perpendicular to the drawing sheet of FIG. 2).

An operation panel 4 is provided in a front end portion of the upper portion of the MFD 1. The operation panel 4 is for operating the printer portion 2 and the scanner portion 3. The operation panel 4 includes various operation keys and a liquid crystal display (LCD) that are used by a user to input various commands to operate the MFD 1. In the case where the MFD 1 is connected to the above-described computer, the MFD 1 is operated according to commands supplied from the computer via a printer driver or a scanner driver. The MFD 1 has, in a left, top portion of the front surface thereof (FIG. 1), a slot portion 5 in which each of various sorts of small-size memory cards each as a data memory can be inserted, and the MFD 1 can read image data stored by the each memory card so that based on the thus read image data, images may be displayed by the LCD of the operation panel 4. The user of the MFD 1 can select, by operating the keys of the operation panel 4, one or more desired images from the images displayed on the LCD, so that the printer portion 2 may record the images on the recording sheets, respectively.

Figure 3:
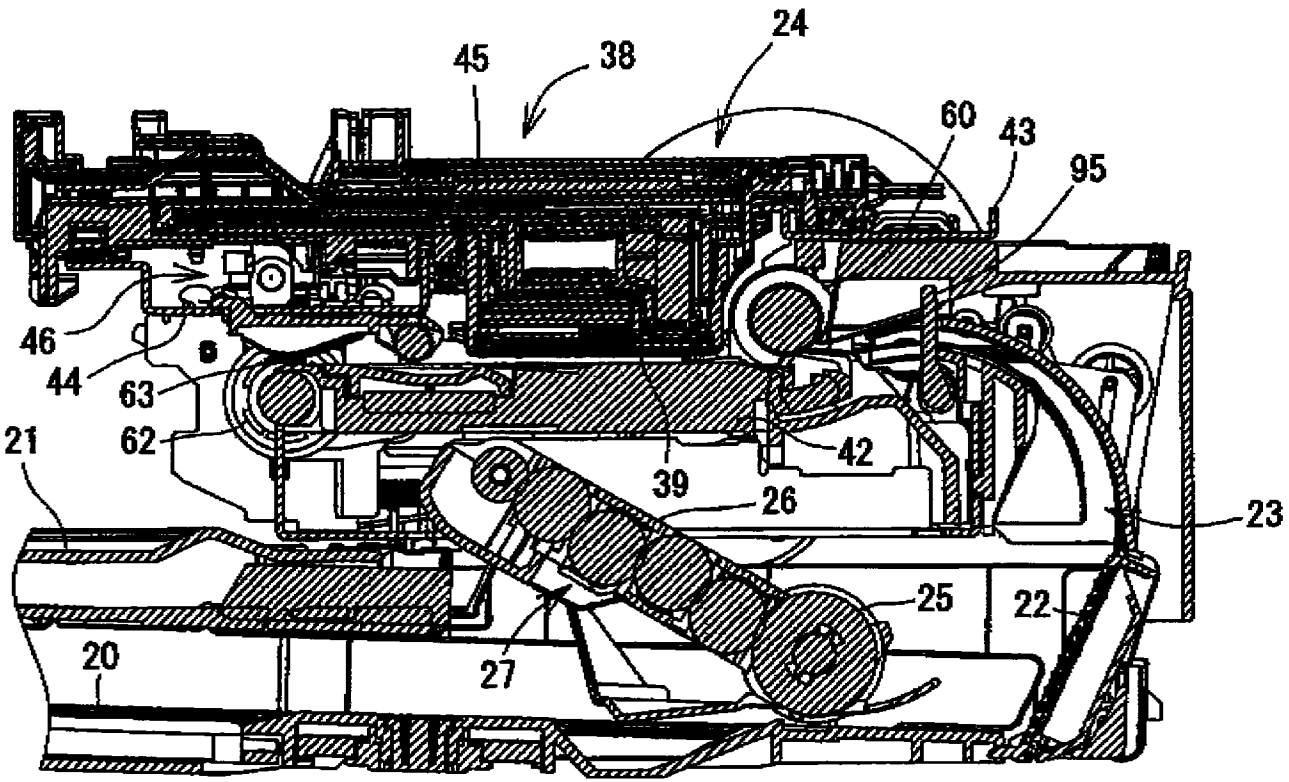
FIG. 3 is an enlarged, cross-sectional view of a printer portion 2 of the MFD 1.

Hereinafter, there will be described an internal construction of the MFD 1, especially a construction of the printer portion 2, by reference to FIGS. 2 through 8. As shown in FIG. 2, the sheet-feed tray 20 is provided in a bottom portion of the MFD 1 and has an inclined sheet-separate plate 22 is provided on a downstream side of the tray 20 with respect to a sheet-feed direction in which each recording sheet is fed or supplied from the tray 20. The inclined sheet-separate plate 22 is for separating each of the recording sheets stacked on the sheet-feed tray 20, from the other recording sheets, and guiding a movement of the each separated recording sheet in an upward direction toward a sheet-feed path 23. As shown in FIG. 3, the sheet-feed path 23 first extends upward, then curves toward the front side (i.e., left side in the figure) of the MFD 1, and further extends to the front opening 13. That is, the sheet-feed path 23 extends from the rear side of the MFD 1 toward the front side thereof via the image recording portion 24 and the sheet-discharge tray 21. Thus, the sheet-feed path 23 includes a U-turn portion through which the direction of feeding of each recording sheet is changed from the rearward direction to the frontward direction before the each recording sheet is fed to the image recording portion 24. After the image recording portion 24 records the image on the each recording sheet, the each sheet is discharged onto the sheet-discharge tray 21.

As shown in FIG. 3, a sheet-supply roller 25 is provided above the sheet-feed tray 20. The sheet-supply roller 25 cooperates with the inclined sheet-separate plate 22 to separate each of the recording sheets stacked on the sheet-feed tray 20, from the other recording sheets, and supply the thus separated recording sheet to the sheet-feed path 23. The sheet-supply roller 25 is rotatably supported by a lower or distal end portion of a sheet-supply arm 26 that is pivotable upward and downward so as to be movable away from and toward the sheet-feed tray 20. The sheet-supply arm 26 supports a power transmission device 27 that includes a plurality of gears meshed with each other and that is connected, at one end thereof, to the sheet-supply roller 25. When a LF (line feed) motor 71 (shown in FIG. 8) that is connected to the other end of the power transmission device 27 is driven or rotated, a driving power of the motor is transmitted to the sheet-supply roller 25 via the transmission device 27, so that the roller 25 is rotated to move each recording sheet toward the inclined sheet-separate plate 22.

Figure 4:
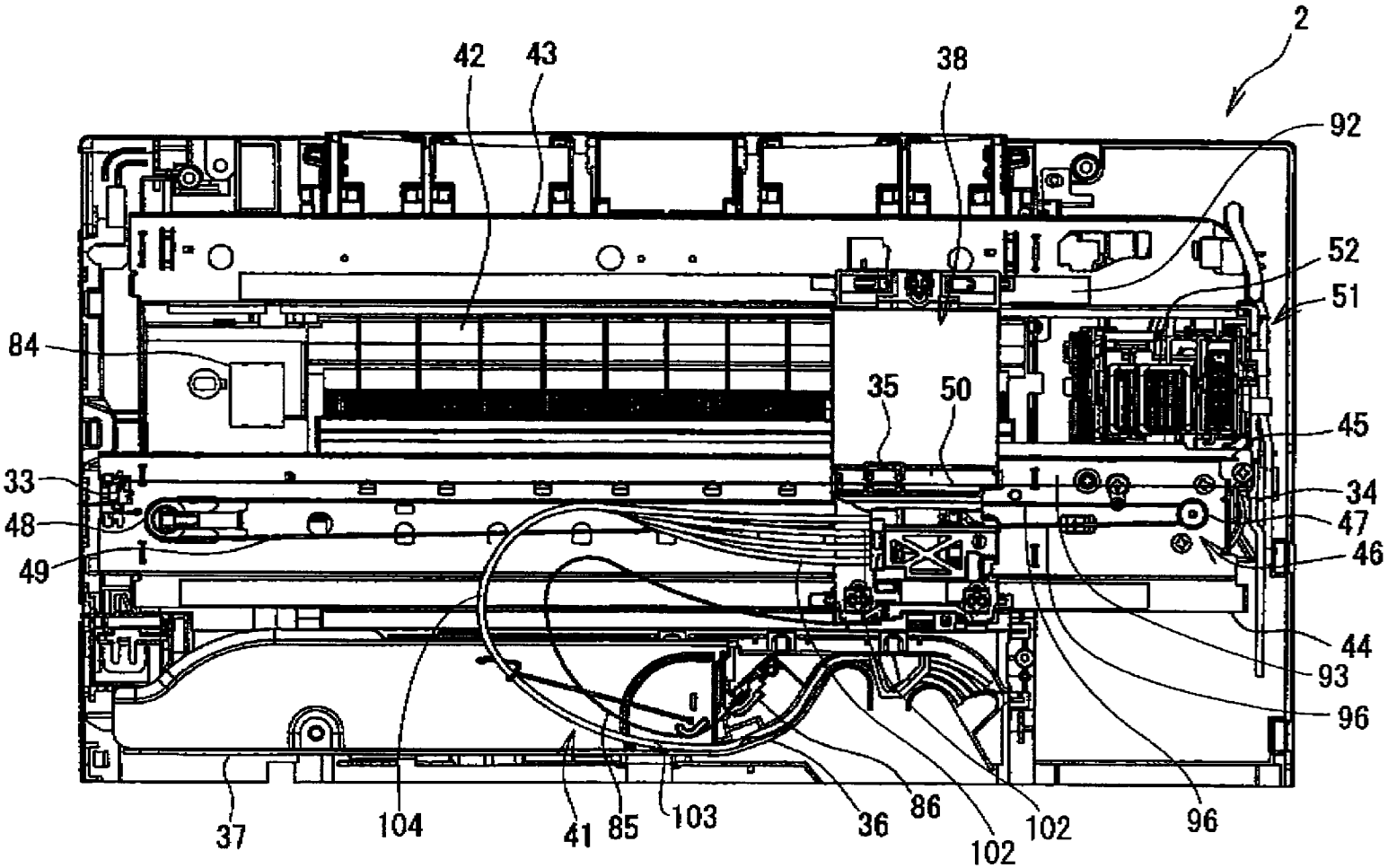
FIG. 4 is a plan view showing a pertinent structure of an image recording portion 24 of the MFD 1.
Figure 5:
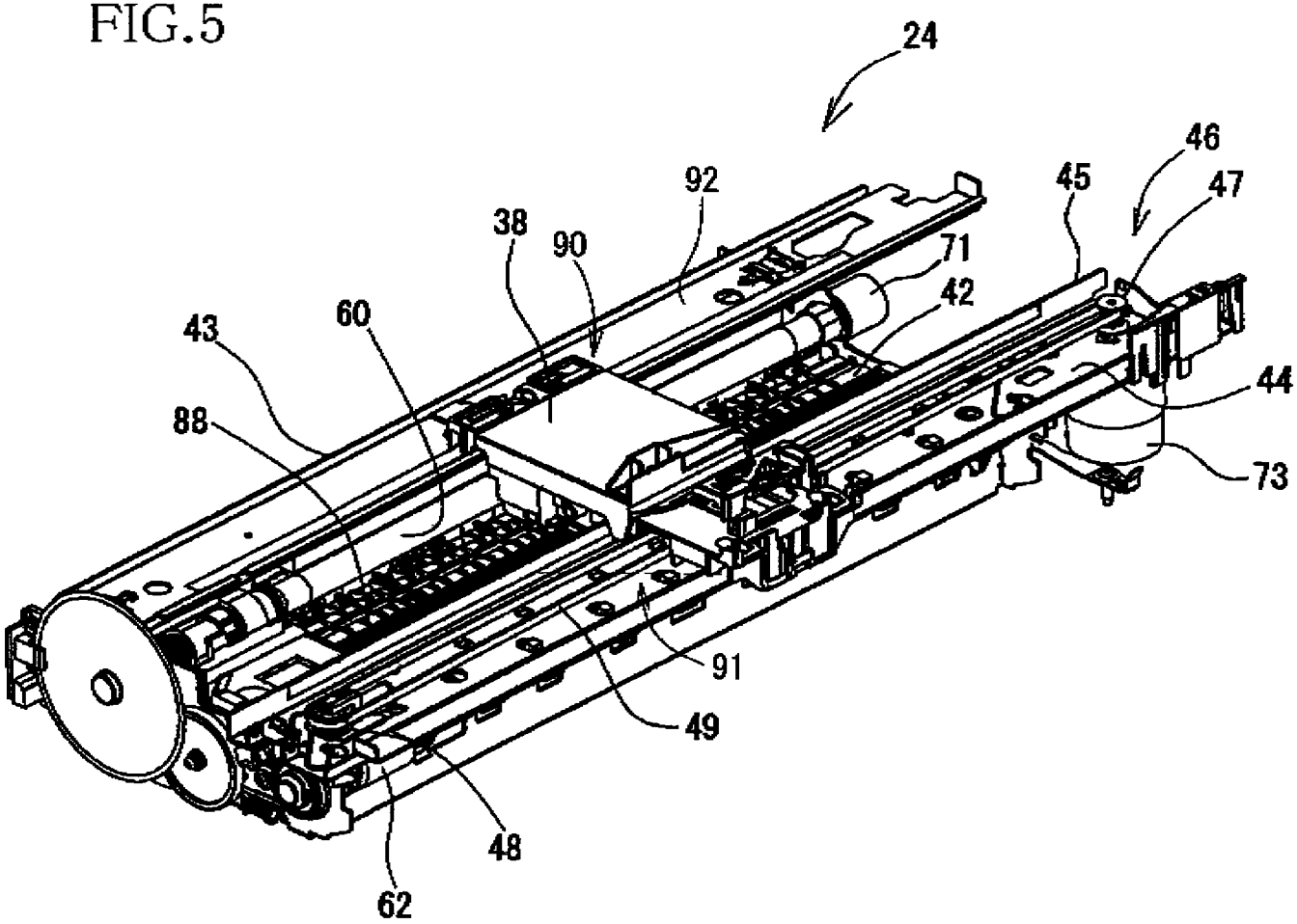
FIG. 5 is a perspective view showing a platen 42 and a structure around the platen 42 of the MFD 1.

As shown in FIG. 3, the image recording portion 24 is provided on a downstream side of the above-described U-turn portion of the sheet-feed path 23. As shown in FIGS. 3 and 4, the image recording portion 24 includes an ink-jet recording head 39 and a carriage 38 that carries the recording head 39 and that can be moved or reciprocated in a main scanning direction Four ink cartridges are provided in the MFD 1, independently of the recording head 39. Four ink cartridges store a cyan ink (C), a magenta ink (M), a yellow ink (Y), and a black ink (K), respectively, and supply those inks to the ink-jet recording head 39 via respective ink-supply tubes 41. A platen 42 is opposed to the ink-jet recording head 39. While the head 39 is reciprocated along a predetermined movement path in the main scanning direction, the ink-jet recording head 39 selectively ejects droplets of the inks toward each recording sheet being fed onto the platen 42. Thus, a desired image is recorded on the recording sheet. The platen 42 extends over an intermediate portion of the range of reciprocating movement of the carriage 38, i.e., a portion of the range where the recording sheets pass. Since a width of the platen 42 as measured in the widthwise direction of the sheet-feed path 23 is larger than a maximum width of all sorts of the recording sheets that can be used with the MFD 1, each recording sheet can pass over the platen 42. As shown in FIG. 5, a movable supporting portion 88 is provided on the platen 42. The movable supporting portion 88 is movable in the sheet-feed direction so as to follow the recording sheet being fed onto the platen 42 and support the recording sheet. The ink cartridges are omitted in FIGS. 3 and 4.

As shown in FIG. 4, the MFD 1 has, in an inner space of a casing of the printer portion 2, a pair of guide rails 43, 44 each as a part of a frame that supports members constituting the printer portion 2. The two guide rails 43, 44 are provided above the sheet-feed path 23 and are spaced from each other by an appropriate distance in the sheet-feed direction (i.e., the frontward direction as seen in FIG. 4) or in a sub-scanning direction which is perpendicular to the main scanning direction of the carriage 38, and extend in parallel with each other and in the direction perpendicular to the sheet-feed direction (in leftward and rightward directions in FIG. 4) or in the main scanning direction. The ink-jet recording head 39 is mounted on the carriage 38, and the carriage 38 bridges the two guide rails 43, 44 in the sheet-feed direction such that the carriage 38 is slidable in the direction perpendicular to the sheet-feed direction or in the lengthwise direction of the MFD 1. Since the pair of guide rails 43, 44 lie on a generally horizontal plane including the sheet-feed direction, the printer portion 2 and the MFD 1 can be made small in height.

The guide rail 43, which is provided on an upstream side of the guide rail 44 in the sheet-feed direction, has such an elongate, flat structure that a length thereof measured in the widthwise direction of the sheet-feed path 23 (in the leftward and rightward directions in FIG. 4) is larger than a length of the range of the reciprocating movement of the carriage 38. An upstream slide portion 90 of the carriage 38 in the sheet-feed direction is mounted on a slide surface (an upper surface) 92 of the guide rail 43, while a downstream slide portion 91 of the carriage 38 is mounted on a slide surface (an upper surface) 93 of the guide rail 44, such that the carriage 38 is supported and guided by the two guide rails 43, 44 to slide in a lengthwise direction of the guide rails 43, 44. The slide surfaces 92, 93 lie on a horizontal plane. An engaged portion 45 is provided by an upstream end portion of the guide rail 44 in the sheet-feed direction that is bent perpendicularly and upwardly. The carriage 38 which is supported by the guide rails 43, 44 slidably engages at an engaging portion 94 thereof with the engaged portion 45. The engaging portion 94 includes pinch members such as a pair of rollers cooperating with each other to grip the engaged portion 45. Thus, the carriage 38 is prevented from being displaced in the sheet-feed direction, while being slidably moved in the direction perpendicular to the sheet-feed direction. That is, the carriage 38 is slidably supported on the two guide rails 43, 44 and reciprocateable in the direction perpendicular to the sheet-feed direction. On the respective slide surfaces 92, 93 of the guide rails 43, 44 and the engaged portion 45, a lubricant such as grease is provided for smooth sliding of the carriage 38. It is noted that the engaging portion 94 engages the engaged portion 45 such that the carriage 38 is separable in a direction away from the slide surfaces 92, 93.

A carriage drive device 46 is provided on the upper surface of the guide rail 44. The carriage drive device 46 includes a driving pulley 47 and a driven pulley 48 which are provided adjacent to respective ends of the guide rail 44 in the widthwise direction of the sheet-feed path 23, and an endless timing belt 49 as a transmission member which is wound on the pulleys 47, 48 and connected at one of a pair of linear portions 96 thereof to the carriage 38, The timing belt 49 has a plurality of teeth formed on its inner surface. The linear portions 96 of the timing belt 49 extend in the widthwise direction of the sheet-feed path 23. The driving pulley 47 (i.e., a shaft portion thereof is driven by a carriage (CR) motor 73 (shown in FIG. 8). When the driving pulley 47 is driven, the timing belt 49 is driven or circulated. The endless timing belt 49 may be replaced with a different timing belt having ends to which the carriage 38 is connected.

The carriage 38 is connected at a bottom thereof to the linear portion 96 of the timing belt 49. Thus, when the timing belt 49 is driven or circulated, the carriage 38 is reciprocated on the two guide rails 43, 44 while being guided by the engaged portion 45. That is, the recording head 39 carried by the carriage 38 is moved in the main scanning direction or in the widthwise direction of the sheet-feed path 23 while being supported by the two guide rails 43, 44.

Figure 8:
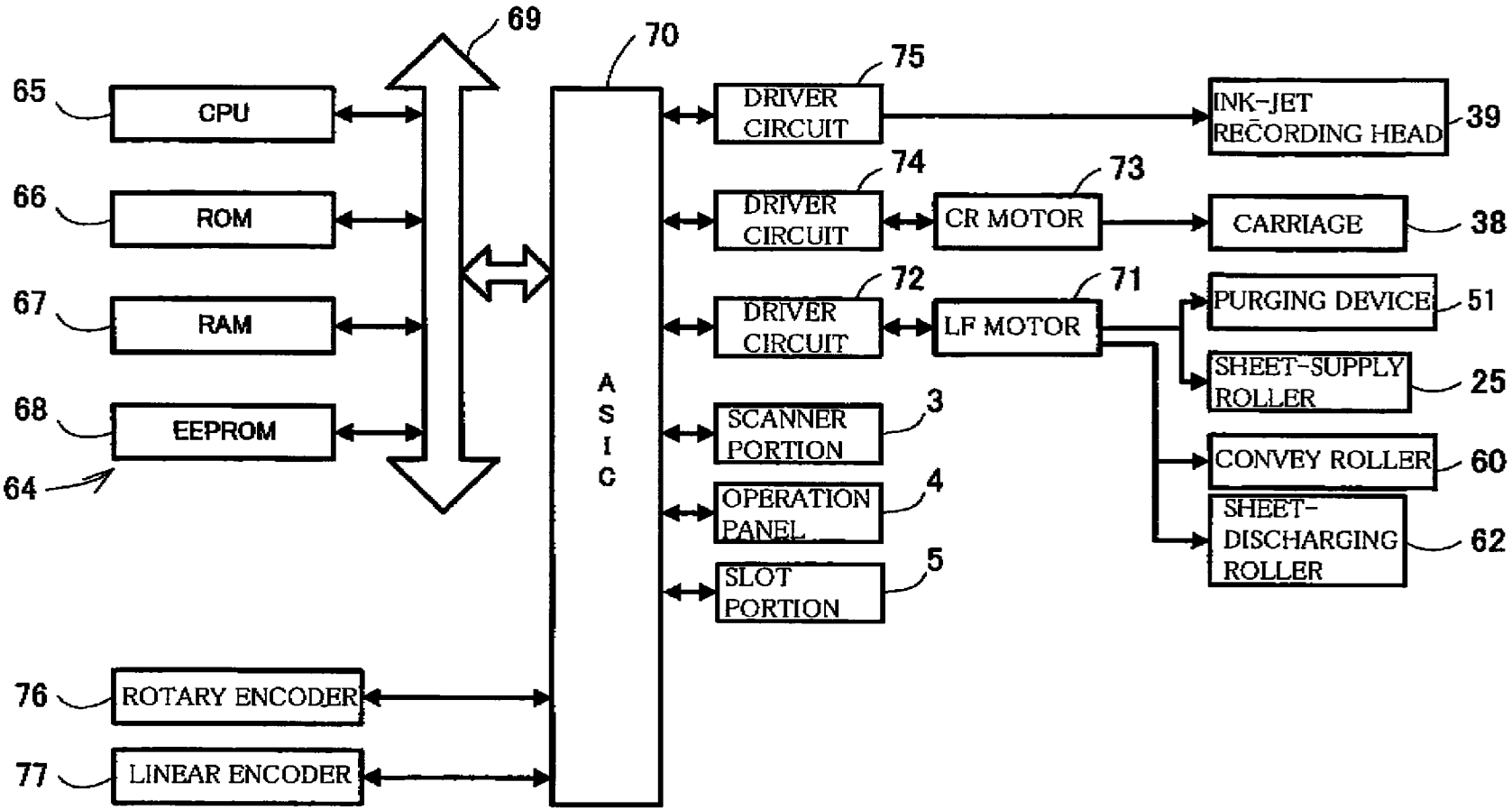
FIG. 8 is a block diagram illustrating an arrangement of a control portion 64 of the MFD 1.

As shown in FIGS. 4 and 8, there is provided an encoder strip 50 of a linear encoder 77 (shown in FIG. 8) as a kind of a carriage movement detector located between the two guide rails 43, 44 in the sheet-feed direction. The encoder strip 50 extends in the widthwise direction of the sheet-feed path 23. There are provided two support portions 33, 34 at respective ends of the guide rail 44 in the lengthwise direction thereof (i.e., in the reciprocating direction of the carriage 38) so as to stand on the upper surface of the guide rail 44. The encoder strip 50 is supported, at respective end portions thereof, by the support portions 33, 34, such that the encoder strip 50 extends along the engaged portion 45. There is provided a spring (not shown) on one of the two support portions 33, 34 for engaging one of the respective end portions of the encoder strip 50. Owing to the spring, a tension is applied to the encoder strip 50 in a lengthwise direction thereof so as to prevent the encoder strip 50 from being slack. Also, in a case in which an external force acts on the encoder strip 50, the spring is elastically deformed so that the encoder strip 50 is allowed to be flexed.

Figure 9:
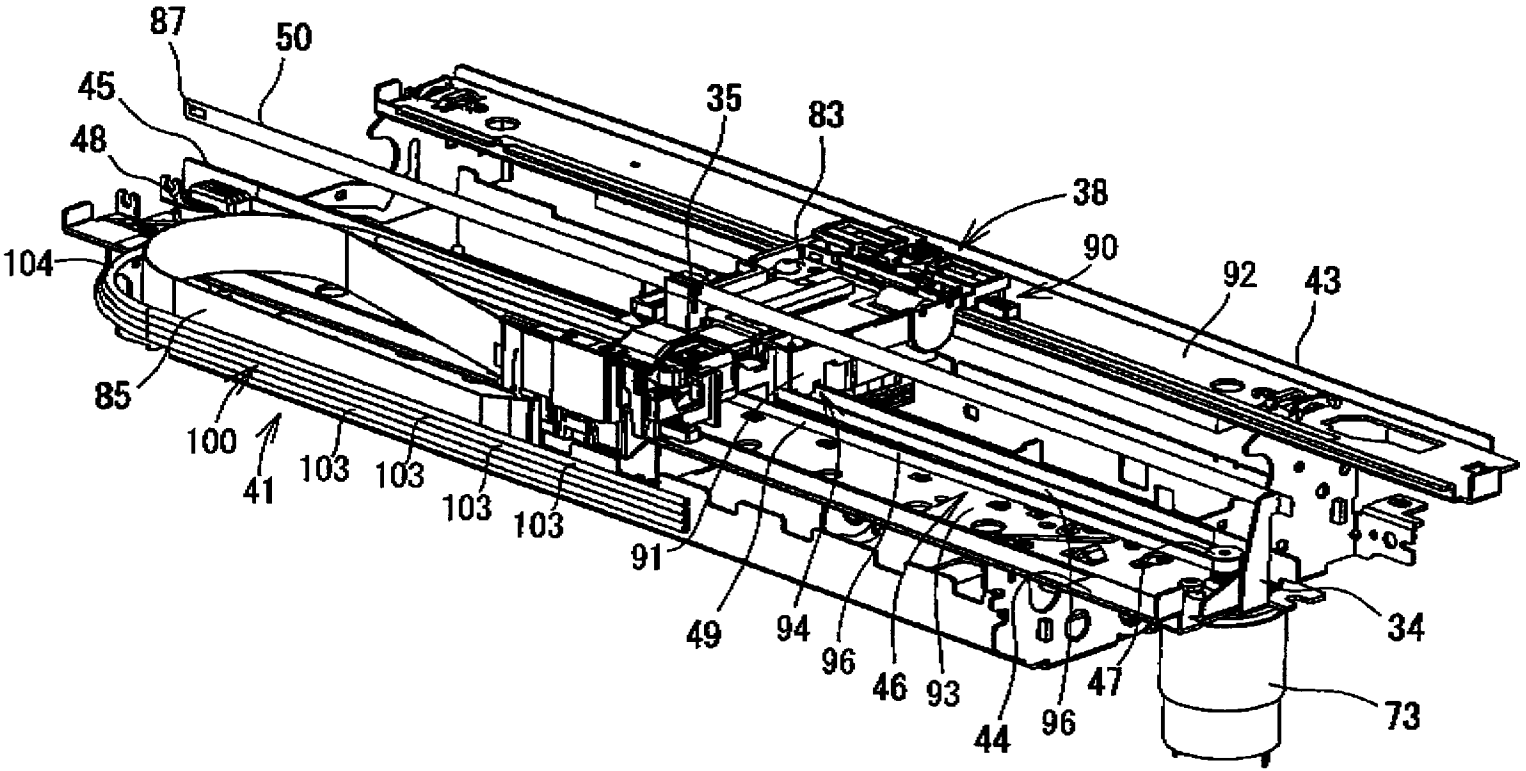
FIG. 9 is a perspective view showing a positional relationship between a carriage 38, ink-supply tubes 41, and a pair of guide rails 43, 44, and an engaged portion 45 that are provided in the MFD 1.

The encoder strip 50 includes transparent portions as sensible portions and shielding portions as non-sensible portions alternately arranged at a predetermined pitch in the lengthwise direction of the same 50. There is an optical sensor 35 of transmission type which is disposed on an upper surface of the carriage 38 so as to be opposed to the encoder strip 50. The optical sensor 35 is reciprocateable along with the carriage 38 in the lengthwise direction of the encoder strip 50 for sensing the sensible portions of the encoder strip 50. As shown in FIG. 9, there is provided a head control board 83 in the recording head 39 for controlling the ink ejection by the recording head 39. The head control board 83 outputs pulse signals based on detection signals produced by the optical sensor 35. Based on the thus outputted pulse signals, a position of the carriage 38 is detected (determined), so that the reciprocating movement of the carriage 38 can be controlled. In the present embodiment, the linear encoder 77 constitutes a carriage movement detector which detects the reciprocating movement of the carriage 38.

As shown in FIG. 4, outside an area through which the recording sheets pass, that is, outside an image recording area corresponding to a width (a short side) of the recording sheets being conveyed, there are provided a maintenance unit including a purging device 51, located on one side in the widthwise direction and another maintenance unit including a waste-ink tray 84, located on the other side in the widthwise direction. These maintenance units can perform maintenance operations to selectively suck the different color inks and remove air bubbles from the recording head 39 and to prevent drying of the inks in the recording head 39. The purging device 51 is for sucking and removing air bubbles and foreign matters from nozzles 53 (shown in FIG. 6) of the recording head 39. The purging device 51 comprises: a cap portion 52 which covers an outer surface (a lower surface) or a nozzle surface 39*a* of the recording head 39 when the recording head 39 is opposed to the purging device 51 and a purging operation is performed; a pumping device which is connected to the recording head 39 via the cap portion 52 when the purging operation is performed; and a moving device which moves the cap portion 52 toward and away from the recording head 39. The pumping device 51 and the moving device are omitted in the FIG. 4. When the purging operation is performed and air bubbles in the recording head 39 are removed, the carriage 38 is moved toward the cap portion 52 in the widthwise direction. Then, the cap portion 52 is moved upward and toward the recording head 39 so as to cover and fluid-tightly close the nozzle surface 39*a* of the recording head 39. When an inner space defined by the nozzle surface 39*a* of the carriage 39 and the cap portion 52 is evacuated to a negative pressure so that inks in the nozzles 53 of the recording head 39 are sucked and removed, air bubbles and foreign matters in the nozzles 53 are also sucked and removed together with the inks.

The waste-ink tray 84 is for performing a flushing operation in which the waste-ink tray 84 receives a waste-ink forcedly ejected by the recording head 39. The waste-ink tray 84 is located within the reciprocation range of the carriage 38 and outside the image recording area of the recording head 39. The waste-ink tray 84 constitutes one of components of the waste-ink retaining device which retains the waste ink forcedly ejected by the recording head 39. The waste-ink retaining device will be described in detail later.

As shown in FIG. 4, there is provided a cartridge accommodating portion 6 in a front portion of the printer portion 2, i.e., a right-hand side in FIG. 4. As shown in FIG. 1, a door 7 is provided in a front surface of the casing of the printer portion 2. The door 7 is pivotable so as to be opened and closed. When the door 7 is opened, the cartridge accommodating portion 6 is exposed to an exterior of the MFD 1 and ink cartridges can be attached to or detached from the cartridge accommodating portion 6. The cartridge accommodating portion 6 has four accommodating portions which accommodate four ink cartridges storing black (B), cyan (C), magenta (M), and yellow (Y) inks, respectively. The ink cartridges are connected to the carriage 38 via respective four ink-supply tubes 41 corresponding to the four inks. The inks are supplied to the recording head 39 carried by the carriage 38 from the ink cartridges accommodated by the cartridge accommodating portion 6 via the respective ink-supply tubes 41.

Each ink-supply tube 41 is formed of a synthetic resin and has a flexibility to be curved so as to follow the reciprocating movement of the carriage 38. One end portion of each ink-supply tube 41 is attached to the cartridge accommodating portion 6, while the other end portion thereof is attached to the carriage 38 (the recording head 39). The ink-supply tubes 41 extend from the cartridge accommodating portion 6 in the lengthwise direction of the MFD 1. The ink-supply tubes 41 are attached or fixed to the frame of the MFD 1 by a fixing clip 36. The ink-supply tubes 41 are not attached to the frame of the MFD 1, at respective portions thereof located between the fixing clip 36 and the carriage 38. Respective portions of the ink-supply tubes 41 located between the cartridge accommodating portion 6 and the fixing clip 36 are omitted in FIG. 4.

As shown in FIG. 4, the portions of the ink-supply tubes 41 located between the fixing clip 36 and the carriage 38 are curved in a generally U-shaped configuration in its plan view or as seen in a vertical direction. In the printer portion 2, there is provided a guide wall 37 extending in the lengthwise direction of the MFD 1 (in the leftward and rightward directions in FIG. 4). The four ink-supply tubes 41 are attached to the frame by the fixing clip 36, at their end portions 103 which are stacked on each other in the vertical direction and which extend in the lengthwise direction along the guide wall 37. The guide wall 37 prevents the ink-supply tubes 41 from protruding toward the front side of the MFD 1. The four ink-supply tubes 41 are curved and twisted in a space between the guide wall 37 and the carriage 38, such that the other end portions 102 attached to respective portions of the carriage 38 are arranged, side by side, in the horizontal direction, and such that the other end portions 102 extend from the respective portions of the carriage 38 in the lengthwise direction of the MFD 1. That is, each ink-supply tube 41 is curved in a generally U-shaped configuration as seen in the vertical direction, so as to have a U-shaped portion including a pair of end portions 102, 103 and a curved portion 104 located between the end portions 102, 103. The pair of end portions 102, 103 extend generally in the lengthwise direction of the MFD 1, and are spaced apart from each other generally in the sheet-feed direction. The end portion 102 located on the upstream side of the end portion 103 in the sheet-feed direction tends to protrude outward (upstream in the sheet-feed direction) because they are not guided by a guide member such as the guide wall 37. It is noted that the above-described end portions of the ink-supply tubes 41 (i.e., the end portions 103 at which the tubes 41 are connected to the frame) do not have to be necessarily stacked on each other without any spacing therebetween but may be arranged with some spacing therebetween in the vertical direction. Further, in the present embodiment, the above-described other end portions of the ink-supply tubes 41 (i.e., the end portions 102 at which the tubes 41 are connected to the carriage 38) are arranged in the horizontal direction.

The curved shape of each ink-supply tube 41 is changed by the reciprocating movement of the carriage 38. Therefore, the four ink-supply tubes 41 can follow the reciprocating movement of the carriage 38 as the curved shapes are changed. As the carriage 38 is moved toward one end (a left-hand side in FIG. 4) in the lengthwise direction of the MFD 1, the end portions 102 are made smaller in length while the end portions 103 are made larger in length. Thus, the curved portions 104 are curved such that respective radii of curvature thereof become smaller. As the carriage 38 is moved toward the other end (a right-hand side in FIG. 4) in the lengthwise direction, the end portions 102 are made larger in length while the end portions 103 are made smaller in length. Thus, the curved portions 104 are curved such that the radii of curvature thereof become larger.

Figure 6:
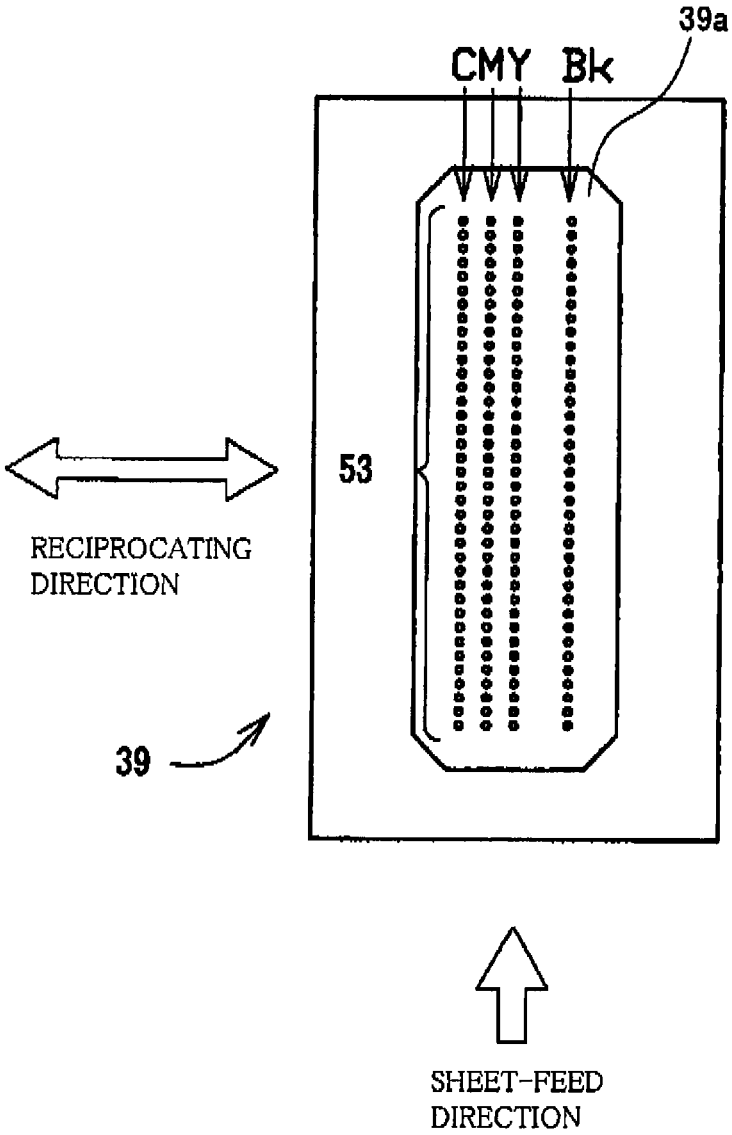
FIG. 6 is a bottom view showing a lower surface (an outer surface) of an ink-jet recording head 39 of the MFD 1.

FIG. 6 shows the nozzle surface 39*a* as the outer surface of the ink-jet recording head 39 in which four groups of ink ejection nozzles 53 respectively corresponding to the four inks, CMYK, open in a downward direction. The ink ejection nozzles 53 of each group are arranged in an array in the sheet-feed direction. Thus, four arrays of ink ejection nozzles 53 corresponding to the cyan ink C, the magenta ink M, the yellow ink Y, and the black ink K are provided, in the order of description, in a direction from the left-hand side of the head 39 toward the right-hand side thereof in FIG. 6. In each array, the ink ejection nozzles 53 are provided at an appropriate pitch. However, the pitch of provision of the nozzles 53 in each array and/or the total number of the nozzles 53 provided in the each array may be changed, as needed, depending upon, e.g., a resolution of images recorded by the printer portion 2. In addition, the total number of the arrays of the ink ejection nozzles 53 may be changed depending upon the total number of the inks used in the MFD 1.

Figure 7:
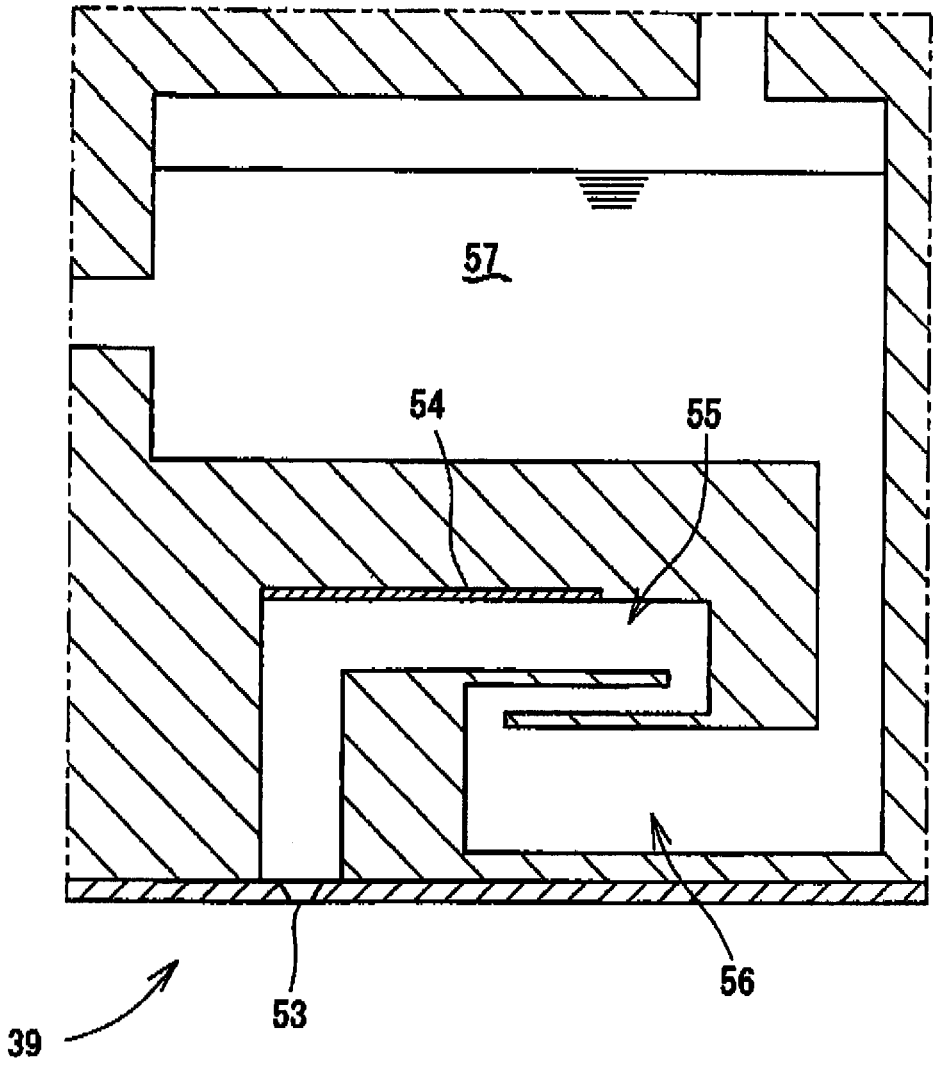
FIG. 7 is an illustrative cross-sectional view schematically showing an internal structure of the ink-jet recording head 39.

As shown in FIG. 7, the four inks supplied from the four ink cartridges via the respective ink-supply tubes 41 flow through ink-supply passages into four arrays of cavities 55 via four buffer tanks 57 and four manifolds 56, respectively The inks C, M, Y, K supplied via the ink-supply passages are ejected as droplets from the nozzles 53 toward the recording sheets by piezoelectric elements 54.

As shown in FIG. 3, a convey roller 60 and a pinch roller are provided on the upstream side of the image recording portion 24. The convey roller 60 and the pinch roller 61 cooperate with each other to nip the recording sheet supplied along the sheet-feed path 23. When the convey roller 60 is rotated, the recording sheet is supplied downstream along the sheet-feed path 23, and is placed on the platen 42. The convey roller 60 is intermittently driven or rotated by the LF motor 71 so as to feed the recording sheet, with an amount of each intermittent motion of the recording sheet corresponding to an amount of each image line. A sheet-discharging roller 62 and a spur roller 63 are provided on a downstream side of the image recording portion 24. The sheet-discharging roller 62 and the spur roller 63 cooperate with each other to nip the recording sheet to which the droplets of inks have been applied and to convey the recording sheet onto the sheet-discharging tray 21. The sheet-discharging roller 62 is intermittently driven or rotated by the LF motor 71 so as to feed the recording sheet, with the amount of each intermittent motion of the recording sheet corresponding to the amount of each image line. The convey roller 60 is rotated in synchronism with the sheet-discharging roller 62. A rotary encoder 76 (shown in FIG. 8) provided for the convey roller 60 includes an optical sensor that detects slits or patterns of an encoder disc which is rotated along with the convey roller 60 and produces pulse signals corresponding to the detected slits. The rotation of the convey roller 60 and the sheet-discharging roller 62 are controlled based on the pulse signals.

The pinch roller 61 is provided to be slidable in a direction toward and away from the convey roller 60 and is elastically biased toward the convey roller 60 so as to press, with an appropriate pressing force, the same 60. Therefore, when the convey roller 60 and the pinch roller 61 cooperate with each other to nip the recording sheet, the pinch roller 61 is elastically retracted by an amount corresponding to the thickness of the recording sheet. Thus, the rotating force of the convey roller 60 is reliably transmitted to the recording sheet. This is true with the sheet-discharging roller 62 and the spur roller 63. In the present embodiment, however, the spur roller 63 presses the recording sheet on which the image has been recorded. Therefore, in order to prevent the deterioration of the image recorded on the recording sheet, the spur roller 63 has a plurality of sharp projections along an outer circumferential surface thereof.

Referring next to the block diagram of FIG. 8, there is shown a control portion 64 for controlling various operations of the MFD 1 including not only the printer portion 2 but the scanner portion 3. Since the scanner portion 3 is not a major component to which the present invention is applied, detailed description thereof is omitted. The control portion 64 is constituted by a microcomputer mainly including a CPU (Central Processing Unit) 65, a ROM (Read Only Memory) 66, a RAM (Random Access Memory) 67, and an EEPROM (Electrically Erasable and Programmable ROM) 68. The control portion 64 is connected to an ASIC (Application Specific Integrated Circuit) 70 through a bus line 69.

The ASIC 70 is operable to control the rotation of the LF motor 71 by generating a signal fed to the LF motor 71 according to a command from CPU 65. The signal is fed to a driver circuit 72, and then a drive signal is fed to the LF motor 71 from the driver circuit 72.

The driver circuit 72 is arranged to drive the LF motor 71 connected to the sheet-supply roller 25, the convey roller 60, the sheet-discharging roller 62 and the purging device 51 and generate an electric signal for rotating the LF motor 71 when an output signal from the ASIC 70 is received. The LF motor 71 is rotated when the electric signal is received and the rotating force of the LF motor 71 is transmitted to the sheet-supply roller 25, the convey roller 60, the sheet-discharging roller 62 and the purging device 51 via a well-known drive device including a gear and a drive shaft.

The ASIC 70 is operable to control the rotation of the CR motor 73 by generating a signal fed to the CR motor 73 according to a command from CPU 65. The signal is fed to a driver circuit 74, and then a drive signal is fed to the CR motor 73 from the driver circuit 74. The carriage 38 is reciprocated when the rotating force of the CR motor 73 is transmitted to the carriage 38 via the carriage drive device 46. As described above, the reciprocating movement of the carriage 38 is controlled by the control portion 64.

A driver circuit 75 is for selectively ejecting ink from the ink-jet recording head 39 toward the recording sheet at a predetermined timing. The driver circuit 75 receives an output signal generated in the ASIC 70 based on a drive control signal outputted from the CPU 65 so as to drive and control the recording head 39. The driver circuit 75 is mounted on the head control board 83.

The rotary encoder 76 and the linear encoder 77 are connected to the ASIC 70. The rotary encoder 76 is arranged to detect an amount of the rotation of the convey roller 60, and the linear encoder 77 is arranged to detect a position of the carriage 38 in the lengthwise direction of the MD) 1. When a power of the MFD 1 is on, the carriage 38 is moved to respective one ends of the guide rails 43, 44 in the lengthwise direction of MFD 1, so that a position detected by the linear encoder 77 is initialized. When the carriage 38 is moved on the guide rails 43, 44 in the lengthwise direction from the initial position, the sensible portions of the encoder strip 50 are sensed by the optical sensor 35 disposed on the carriage 38, and the number of pulse signals produced based on the sensing of the sensible portions by the sensor 35 are fed to the control portion 64 as an amount of the movement of the carriage 38. Based on the amount of the movement of the carriage 38, the control portion 64 controls the rotation of the CR motor 73 so as to control the reciprocating movement of the carriage 38.

As shown in FIG. 4, the control portion 64 is constituted by a main board 82. Signals for the image recording and so on are transmitted to the head control board 83 of the recording head 39 from the main board 82 through a flat cable 85. The flat cable 85 has a flat belt-like shape, and includes a plurality of conductors and an insulating film formed of a synthetic resin such as a polyester film and covering the conductors. The main board 82 is electrically connected to the head control board 83 through the flat cable 85. The flat cable 85 extends at one end portion thereof from the carriage 38 in a way in which a front and a rear surface of the belt-like shape thereof are vertical. The flat cable 85 is curved in a generally U-shaped configuration in its plan view or as seen in a vertical direction in a space inside the ink-supply tubes 41 and is fixed to the frame of the MFD 1 by a fixing clip 86. The other end portion of the flat cable 85 extends from the fixing clip 86 and is attached or fixed to the main board 82. Since a curved portion of the flat cable 85 is not fixed to any members, the curved shape of the flat cable 85 can be changed so as to follow the reciprocating movement of the carriage 38, similarly to the ink-supply tubes 41.

Referring next to FIG. 9, there will be described a positional relationship between the carriage 38, the ink-supply tubes 41, the pair of guide rails 43, 44 and the encoder strip 50, which is established in the MFD 1. In FIG. 9, an upper cover member of the carriage 38 is removed so that the head control board 83 is exposed outside. In FIG. 9, the support portion 33 of the guide rail 44 is not shown, and the ink-supply tubes 41 and the flat cable 85 are partially omitted in the illustration.

As shown in FIG. 9, the guide rails 43, 44 have the respective slide surfaces 92, 93. The slide surfaces 92, 93 consist of respective upper surfaces of the guide rails 43, 44 which are disposed at respective downstream portions of the guide rails 43, 44 in the sheet-feed direction and each of which extends in parallel with the lengthwise direction of the MFD 1. The carriage 38 is supported at the slide portions 90, 91 thereof or respective end portions thereof in the sheet-feed direction by the slide surfaces 92, 93 of the guide rails 43, 44. The carriage 38 is slidable on the slide surfaces 92, 93 in the lengthwise direction, but the slide surfaces 92, 93 are not for preventing the carriage 38 from moving in the sheet-feed direction. That is, the carriage 38 would be movable in the sheet-feed direction relative to the slide surfaces 92, 93, without the engaged portion 45 of the guide rail 44.

As mentioned above, the guide rail 44 has the engaged portion 45 as the upstream edge portion thereof in the sheet-feed direction. The engaged portion 45 extends in the lengthwise direction and has a vertical surface as an engaged surface which extends in the reciprocating direction of the carriage 38. The carriage 38 includes the engaging portion 94 which engages the engaged portion 45 so as to be movable in the lengthwise direction and immovable in the sheet-feed direction relative to the guide rails 43, 44. The engaged portion 45 is located between the slide surfaces 92, 93 in the sheet-feed direction. The engaged portion 45 and the engaging portion 94 have dimensions each lying within respective predetermined tolerances for providing a play between the engaging portion 94 and the engaged portion 45, which play facilitates an assembling of the carriage 38 and a smooth sliding of the carriage 38. Therefore, while the engaging portion 94 engages the engaged portion 45, the carriage 38 may rotate on a horizontal plane about an axis and accordingly change its posture due to the presence of the above-described play. The rotation axis passes the engaged portion 45 and extends in the vertical direction. If the engaged portion 45 were located outside of the slide surfaces 92, 93 in the sheet-feed direction, at least one of respective distances between the engaged portion 45 and the slide surfaces 92, 93 in the sheet-feed direction could be larger than those of the present embodiment. Accordingly, at least a distance between the engaged portion 45 and the end portion of the carriage 38 supported by one of the slide surfaces 92, 93 which is more distant from the engaged portion 45 in the sheet-feed direction could be larger compared to the present embodiment, so that the end portion of the carriage 38 more distant from the engaged portion 45 would be more moved in the lengthwise direction of the slide surfaces 92, 93 by the rotation of the carriage 38 on the horizontal plane, causing the recorded image to be poor in quality or defective. In the present embodiment, the engaged portion 45 is located between the slide surfaces 92, 93, so that the carriage 38 can reciprocate with high stability, leading to improving the quality of images recorded on each recording sheet.

As shown in FIG. 9, the encoder strip 50 is supported by the support portions 33, 34 which stand on the respective end portions of the guide rail 44 in the lengthwise direction of the guide rail 44. Two engaging holes 87 are formed on lengthwise opposite ends of the encoder strip 50. Each of the support portions 33, 34 includes a hook portion extending toward the encoder strip 50 in the horizontal direction. Each hook portion is inserted into the respective one of the engaging holes 87 so that the encoder strip 50 is supported at the lengthwise opposite ends thereof by the support portions 33, 34. The encoder strip 50 is located between the slide surfaces 92, 93 of the guide rails 43, 44 in the sheet-feed direction. As described above, the carriage 38 tends to rotate about the axis due to the tolerance with respect to the dimensions of the engaging portion 94. If the encoder strip 50 were located outside the slide surfaces 92, 93 in the sheet-feed direction, a distance between the engaged portion 45 and the encoder strip 50 in the sheet-feed direction could be larger than that of the present embodiment. Accordingly, a portion of the carriage 38 by which the encoder strip 50 is detected would be more rotated compared to the present embodiment, causing the accuracy of the position detection of the carriage 38 by the linear encoder 77 to be lowered. Therefore, since the encoder strip 50 is located between the slide surfaces 92, 93 in the present embodiment, the position of the carriage is detected with high accuracy by the linear encoder 77 and the carriage 38 can be controlled with high stability.

It is preferable that the engaged portion 45 and the encoder strip 50 are aligned with a center of gravity of the carriage 38 in their plan view. The engaged portion 45 and the encoder strip 50 may be slightly offset from the center of gravity of the carriage 38. In such an offset arrangement, the offset amount (by which the engaged portion 45 or the encoder strip 50 is offset from the center of gravity of the carriage 38) is preferably less than 20% of the distance between the two guide rails 43, 44 in the sheet-feed direction (i.e., a distance between centers of the respective slide surfaces 92, 93 as measured in the sheet-feed direction), more preferably less than 10% or 5% thereof. Since the engaged portion 45 and the encoder strip 50 are substantially aligned with the center of gravity of the carriage 38, the engaged portion 45 and the encoder strip 50 are free of the influence caused by the rotation of the carriage 38, so that the carriage 38 can reciprocate with high stability.

The above discussion can be applied to a relationship between a line of action of a drive force by the carriage drive device 46 and the center of gravity of the carriage 38, as described below. The carriage 38 reciprocates on the two guide rails 43, 44 when the timing belt 49 of the carriage drive device 46 applies a drive force to the carriage 38 so as to reciprocate the carriage 38 in the lengthwise direction, such that the applied drive force acts on the carriage 38 along a line of action that is aligned with the center of gravity of the carriage 38. If the line of action (corresponding to a position where one of the linear portions 96 of the timing belt 49 is attached to the carriage 38) is offset from the center of gravity of the carriage 38, the carriage 38 can be rotated about the center of gravity by receiving a rotary moment from the timing belt 49. The center of gravity of the carriage 38 is a position least influenced by the rotation of the carriage 38. It is common that at least one of the engaged portion 45 and the timing belt 49 should be offset from the center of gravity of the carriage 38 for avoiding interference of the engaged portion 45 with the timing belt 49. In the present embodiment, the engaged portion 45 is slightly offset from the center of gravity of the carriage 38.

As shown in FIG. 4, the space within which the U-shaped portion of each ink-supply tube 41 is changeable is located to overlap the guide rails 43, 44 and the encoder strip 50 in their plan view. As the carriage 38 is moved toward one end (a right-hand side in FIG. 4) in the lengthwise direction of the MFD 1, the curved portion 104 of each ink-supply tube 41 is changed such that the radius of curvature thereof becomes larger than that in a state shown in FIG. 4. In this instance, actually, the end portion 102 is caused to protrude toward the rear side of the MFD 1 as the radius of curvature of each curved portion 104 becomes larger by the reciprocating movement of the carriage 38, because the ink-supply tubes 41 are prevented from protruding toward the front side of the MFD 1 by the guide wall 37. The protruded portions of the end portions 102 are aligned with the engaged portion 45 and the encoder strip 50 in the vertical direction and protrude above the platen 42. Thus, the MFD 1 can enjoy a reduced size, as compared with a case in which the space for accommodating the protruded portions of the end portions 102 are located in a place where the guide rails 43, 44 and the encoder strip 50 are not disposed.

As shown in FIG. 9, the engaged portion 45, the encoder strip 50, and the ink-supply tubes 41 are located on the downstream side with respect to a center of the carriage 38 in the sheet-feed direction. That is, the engaged portion 45, the encoder strip 50 and the ink-supply tubes 41 are offset from the center of the carriage 38 in the sheet-feed direction at least when the carriage 38 is positioned in the left end position as seen in FIG. 4, namely, at least when no portion of each ink-supply tube 41 is located on a rear side of the portion of the carriage 38 to which the ink-supply tube 41 is connected. Thus, a space on the upstream side in the sheet-feed direction can be downsized, leading to a reduction in the overall size of the MFD 1. Also, since the engaged portion 45, the encoder strip 60, and the ink-supply tubes 41 are located on the same side in the sheet-feed direction, these members may be close to each other. However, as discussed below, the encoder strip 50 and the engaged portion 45 are arranged on an upper side and a lower side, respectively, with respect to the carriage 38 so as not to contact with each other. Also, the ink-supply tubes 41, the engaged portion 45 and the encoder strip 50 are separated in the vertical direction so as not to contact with each other. In a case in which the engaged portion 45, the encoder strip 50, and the ink-supply tubes 41 are located on the upstream side with respect to the center of the carriage 38 in the sheet-feed direction, the MFD 1 can enjoy the same advantage as mentioned above.

As shown in FIG. 9, the engaged portion 45 of the guide rail 44 is located below the carriage 38, and the encoder strip 50 is located above the carriage 38. That is, the pair of guide rails 43, 44 are located on one of opposite sides of the carriage 38 in the vertical direction, while the encoder strip 50 is located on the other of the opposite sides of the carriage 38 in the vertical direction. As described above, the lubricant such as grease is provided on the engaged portion 45 for smooth sliding of the carriage 38. The encoder strip 50 is elastically supported by the support portions 33, 34 so as to be flexed appropriately when an external force is applied thereto. For example, in the event that a recording sheet is jammed on the platen 42, when an operator puts his/her hands into a space between the two guide rails 43, 44 for removing the jammed sheet, the operator may contact the encoder strip 50. When the external force is applied from the operator to the encoder strip 50, the encoder strip 50 may be flexed so as to contact the engaged portion 45. This causes the encoder strip 50 to be soiled with the lubricant on the engaged portion 45, whereby the sensible portions could become undetectable by the optical sensor 35. In the present embodiment, since the engaged portion 45 is located below the carriage 38 and the encoder strip 50 is located above the same 38, the engaged portion 45 and the encoder strip 50 are physically isolated by the carriage 38 from each other in the vertical direction, so that the encoder strip 50 does not contact the engaged portion 45 even when the encoder strip 50 is flexed. Therefore, the carriage 38 is prevented from being uncontrolled because the encoder strip 50 becomes undetectable, and can be controlled to reciprocate with high stability.

As shown in FIG. 9, the four ink-supply tubes 41 are located within a space between the pair of guide rails 43, 44 and the encoder strip 50 in the vertical direction. Each ink-supply tube 41 has the curved shape that is changeable in the space by the reciprocating movement of the carriage 38, without any portion of the ink-supply tube 41 being excluded from the space. In other words, the encoder strip 50, the ink-supply tubes 41, and the engaged portion 45 are arranged in this order in the downward direction, such that the encoder strip 50, the ink-supply tubes 41 and the engaged portion 45 do not interfere with each other. As described above, the curved shape of each ink-supply tube 41 is changed so as to follow the reciprocating movement of the carriage 38. In this instance, a portion of each ink-supply tube 41 is caused to protrude in the horizontal direction, so as to overlap the engaged portion 45 and the encoder strip 50 in the vertical direction. The protruding portions of the respective end portions 102 are located between the engaged portion 45 and the encoder strip 50 in the vertical direction without contacting the engaged portion 45 or the encoder strip 50. This arrangement is effective to prevent the lubricant (provided on the slide surfaces 92, 93 of the guide rails 43, 44 and the engaged portion 45) from adhering to the encoder strip 50 via the ink-supply tubes 41. Therefore, the carriage 38 is prevented from being uncontrolled because the encoder strip 50 becomes undetectable, and can be controlled to reciprocate with high stability.

As described above, the engaged portion 45 and the encoder strip 50 are physically separated by the carriage 38 from each other in the vertical direction. Thus, there is provided a space corresponding to a height of the carriage 38 between the engaged portion 45 and the encoder strip 50. Since the ink-supply tubes 41 are disposed such that their protruding portions can protrude into the space, the space can be utilized effectively, leading to reduction in the vertical size of the MFD 1.

As shown in FIG. 9, the optical sensor 35, which senses the sensible portions of the encoder strip 50, is fixed directly to the head control board 83 and projects from the carriage 38 upward or in a direction away from the guide rails 43, 44 in the vertical direction. Since the optical sensor 35 is fixed directly to the head control board 83, there is no need for a wiring between the optical sensor 35 and the head control board 83. Further, when the head control board 83 is attached to the carriage 38, the optical sensor 35 is simultaneously attached to the carriage 38, leading to reduction in the production cost of the MFD 1.

In the present embodiment, the pair of guide rails 43, 44 are distant from each other in the sheet-feed direction. That is, although it is preferable that the two guide rails 43, 44 are distant from each other exactly in the sheet-feed direction, the guide rails 43, 44 may be distant from each other in a direction that is slightly inclined to the sheet-feed direction, so that the guide rails 43, 44 cooperate with each other to constitute a so-called slant-type guide device. In other words, the guide rails 43, 44 may be distant from each other in the vertical direction as well as in the horizontal direction, as long as a distance therebetween as measured in the horizontal direction is larger than that as measured in the vertical direction. Where the guide rails 43, 44 constitute the slant-type guide device, an angle of the inclination is preferably less than 15 degrees, more preferably less than 10 degrees or 5 degrees.

Figure 10:
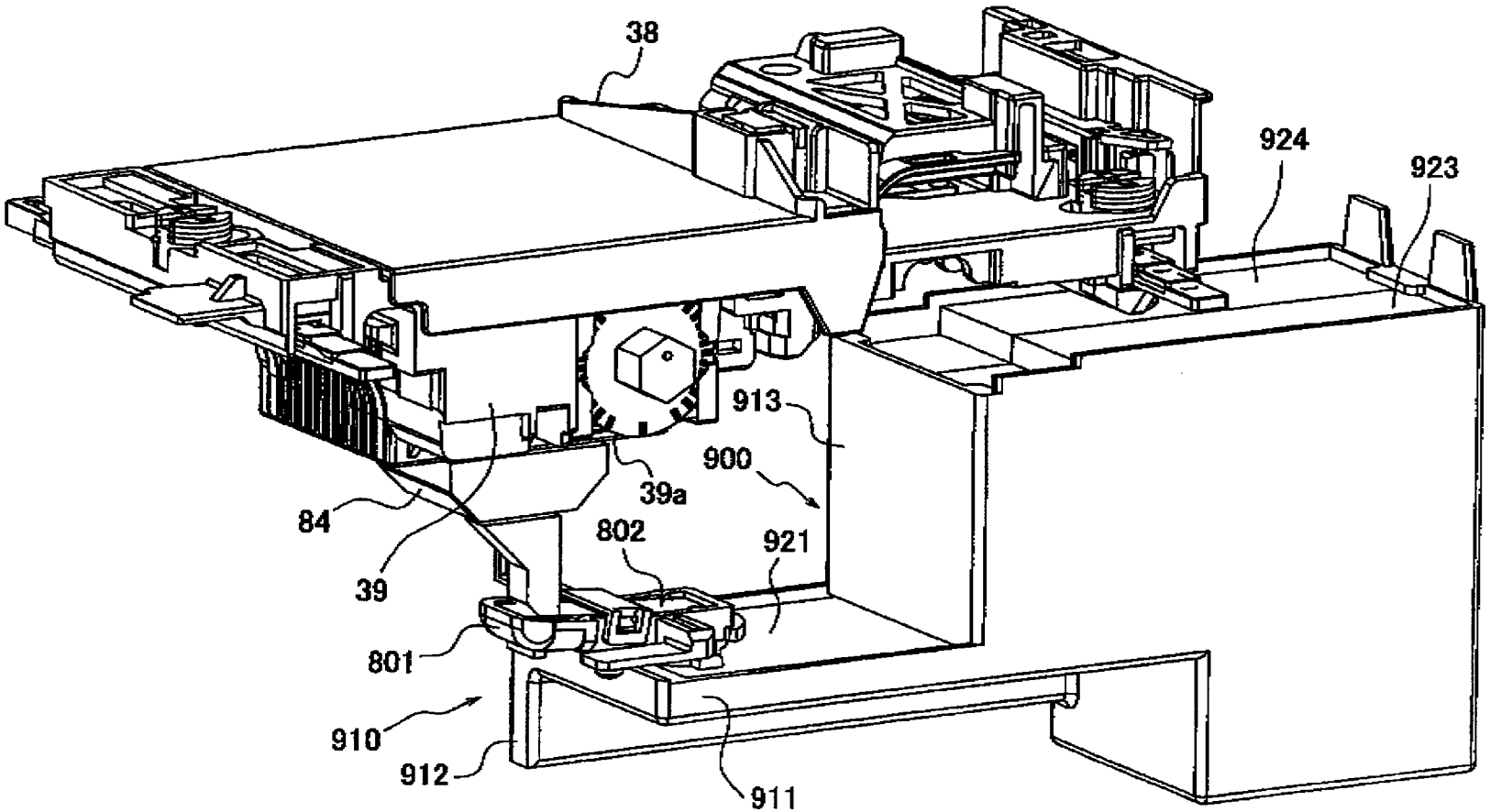
FIG. 10 is a perspective view showing a waste-ink retaining device and a structure around the waste-ink retaining device of the image recording portion 24 of the MFD 1.
Figure 11:
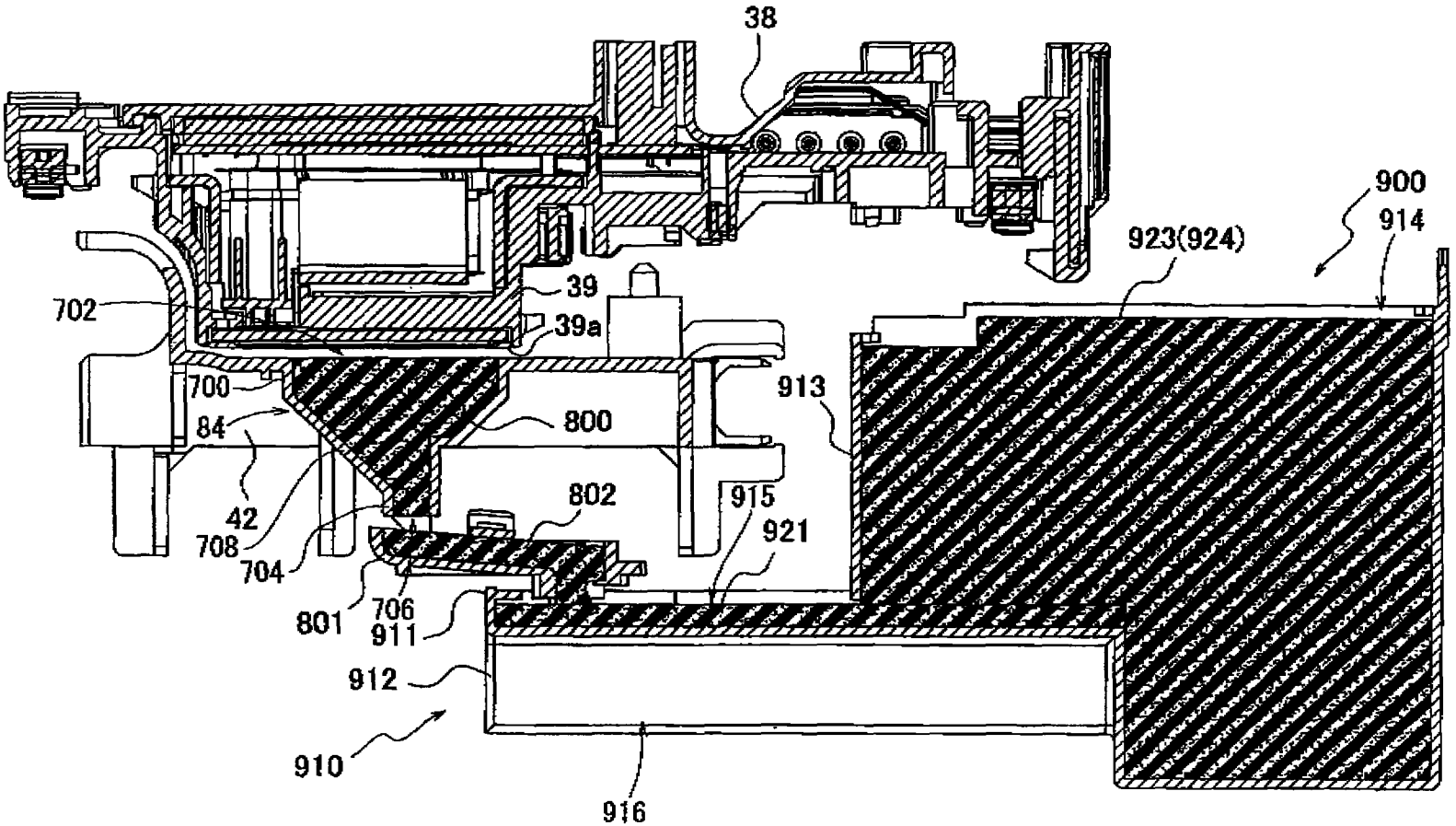
FIG. 11 is a cross-sectional view of FIG. 10.

Next, there will be described the waste-ink retaining device including the waste-ink tray 84. As shown in FIGS. 10 and 11, the waste-ink tray 84 is formed of a synthetic resin by molding and is funnel-shaped, including an upper portion 700 having a first opening 702, a lower portion 704 having a second opening 706 and an intermediate portion 708. The first opening 702 of the upper portion 700 faces upward and is opposed to the recording head 39 when the recording head 39 is moved to a flushing position to perform the flushing operation. The second opening 706 of the lower portion 704 faces downward to a second tray 801 which is described below. The intermediate portion 708 connects the upper portion 700 and the lower portion 704 to each other and a cross section area of the intermediate portion 708, taken horizontally, decreases in a direction from the upper portion 700 to the lower portion 704. The waste-ink tray 84 accommodates a first porous member (for example, a member which is known as a product name "Basotect" produced by BASF) 800 through which the waste ink can permeate quickly downward. Below the waste-ink tray 84, there is provided the second tray 801 which constitutes a gutter and is formed of a synthetic resin by molding. The second tray 801 accommodates a second porous member 802 which is constituted similarly to the first porous member 800. The second porous member 802 has an upper surface held in contact with a lower surface of the first porous member 800 accommodated in the waste-ink tray 84.

Below and to a front end (i.e., a downstream end in the sheet-feed direction) of the second tray 801 in the MFD 1, there is provided a waste-ink retaining portion 900 as another portion of the waste-ink retaining device. The waste-ink retaining portion 900 includes a casing 910 which is formed of a synthetic resin by molding. The casing 910 includes: an ink-receiving-member supporting portion 911 which is provided below the second tray 801 and which has a planer shape horizontally extending in the sheet-feed direction as a fist direction; a pendent-member supporting portion 912 which is pendent from a left-hand side shown in FIG. 10 (a side to which the purging device 51 is located) of the ink-receiving-member supporting portion 912 and extends in the sheet-feed direction; and an ink-retaining-member supporting portion 913 which has a rectangular shape defining a first inner space 914 extending upward from a front end (i.e., a downstream end in the sheet-feed direction) of the ink-receiving-member supporting portion 911 such that a top end of the first inner space 914 is positioned higher than a height position of the nozzle surface 39*a* of the recording head 39. Apparently shown in FIGS. 10 and 11, a front end portion (i.e., a downstream end portion in the sheet-feed direction) of the ink-retaining-member supporting portion 913 extends downward such that a bottom end thereof is positioned lower than a height position of the ink-receiving-member supporting portion 911.

Figure 12:
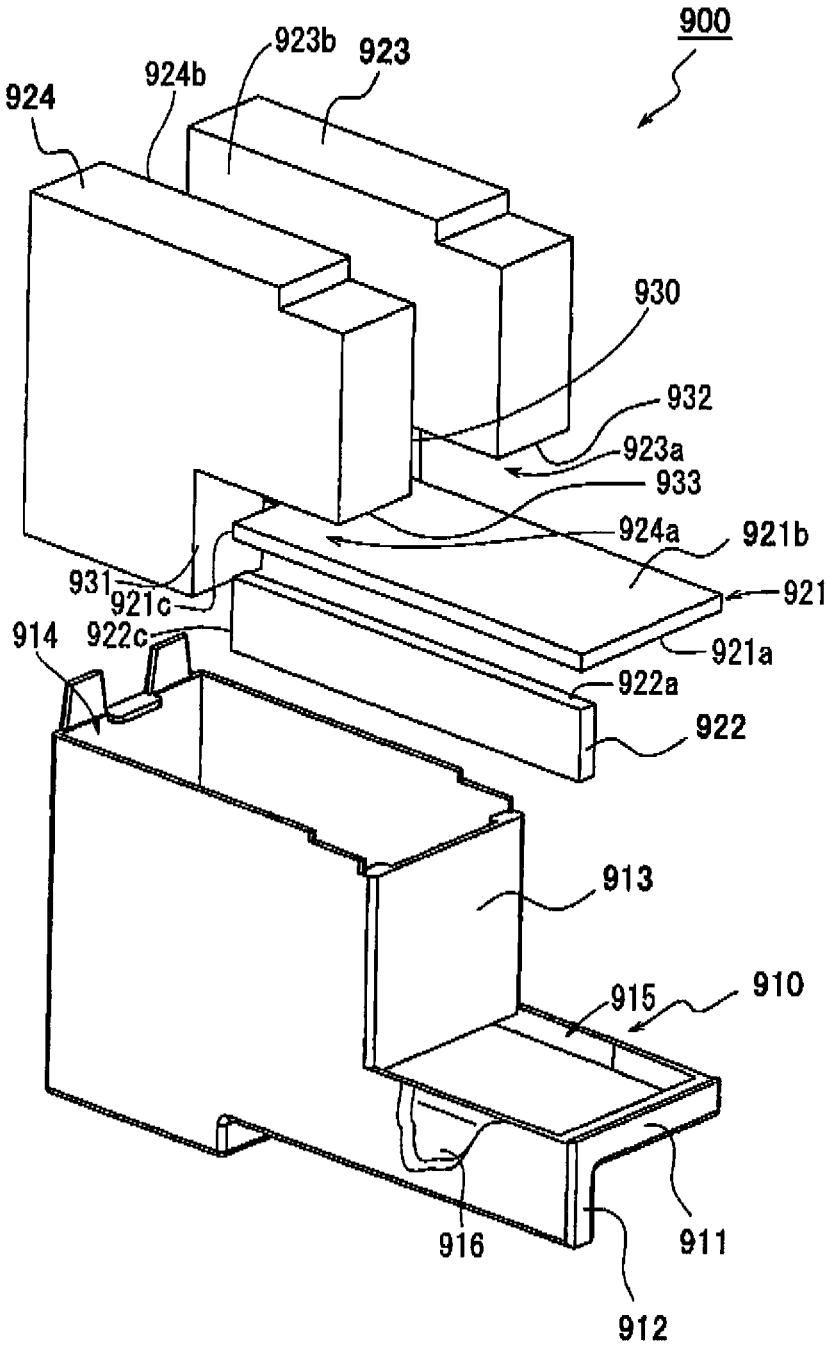
FIG. 12 is an exploded perspective view showing the waste-ink retaining device.

The casing 910 accommodates and supports an ink retaining member which consists of four ink absorbing blocks (for example, a product name "Hato-Sheet" produced by Oji Kinocloth Co., Ltd.). That is, as shown in FIG. 12, the ink-receiving-member supporting portion 911 has a recessed portion 915 opening upward and extending horizontally and accommodates and supports an ink-receiving plate member 921 as one of the four ink absorbing blocks in the recessed portion 915. The pendent-member supporting portion 912 has a second inner space 916 communicating with the recessed portion 915 of the ink-receiving-member supporting portion 911 and which accommodates a pendent member 922 as a second one of the four ink absorbing blocks in the second inner space 916. The pendent member 922 as a second ink retaining member has an upper surface 922*a* as a second surface held in contact with a left-hand end portion in FIG. 12 (i.e., an end portion nearer to the purging device 51 in the lengthwise direction) of a lower surface 921*a* of the ink-receiving plate member 921. The first inner space 914 of the ink-retaining-member supporting portion 913 communicates with the recessed portion 915 of the ink-receiving-member supporting portion 911 and the second inner space 916 of the pendent-member supporting portion 912. The ink-retaining-member supporting portion 913 accommodates and supports two first ink retaining members 923, 924 as third and fourth ones of the four ink absorbing blocks in the first inner space 914 such that respective vertical side surfaces 923*b*, 924*b* of the first ink retaining members 923, 924 are held in contact with each other. Each of the first ink retaining members 923, 924 is a plate member which has a generally rectangular parallelepiped shape and whose width, measured in a direction in which the first ink retaining members 923, 924 are arranged, is smaller than a height thereof and a dimension thereof measured in a direction perpendicular to respective directions in which the width and the height are measured. Each of the first ink retaining members 923, 924 has a rectangular cutout 923*a*, 924*a*, on an upstream side thereof in the sheet-feed direction, which is defined by a vertical surface 930, 931 and a horizontal surface 932, 933 facing downward, respectively. The horizontal surfaces 932, 933 of the cutout 923*a*, 924*a*, as the first surfaces, are respectively held in contact with the upper surface 921*b* of the ink-receiving plate member 921, and the vertical surfaces 930, 931 thereof are respectively held in contact with respective end surfaces 921*c*, 922*c* of the ink-receiving plate member 921 and the pendent member 922, In the present embodiment, when the recording head 39 is moved to the flushing position above the waste-ink tray 84 to perform the flushing operation, a waste ink forcedly ejected by the nozzles 53 of the recording head 39 is received by the waste-ink tray 84 and then the second tray 801, so that the waste ink permeates downward through the first porous member 800 and the second porous member 802 to the upper surface 921*b* of the ink-receiving plate member 921. The ink-receiving plate member 921 receives the waste ink from the second tray 801, and then, the first ink retaining members 923, 924 and the pendent member 922 receives and retains the waste ink from the ink-receiving plate member 921. In the MFD 1, since the first ink retaining members 923, 924, whose top ends are fixedly positioned higher than a height position of the ink-receiving plate member 921, receives and retains the waste ink ejected by the recording head 39, a degree of freedom of provision of the waste-ink retaining portion 900 can be improved, leading to downsizing the MFD 1.

Also, the first ink retaining members 923, 924 extend upward such that the top ends thereof are fixedly positioned higher than a height position of the nozzle surface 39*a* of the recording head 39. Accordingly, the waste-ink retaining portion 900 can be provided more freely, leading to further downsizing the MFD 1. In the present embodiment, in a case in which various devices are provided below the platen 42, it is difficult to have an enough space for the waste-ink retaining portion 900 below the platen 42. Thus, the MFD 1 can enjoy the unrestricted provision of the waste-ink retaining portion 900. A portion of the waste-ink retaining portion 900 (i.e., the first ink retaining members 928, 924), not shown in FIG. 4 because of being covered by other members, is located right below, and adjacent to, a lower surface of the guide rail 44. A clearance between an upper surface of the waste-ink retaining portion 900 (i.e., the first ink retaining members 923, 924) and the lower surface of the guide rail 44 is preferably less than 8 mm and, in the present embodiment, is less than 3 mm.

In the present embodiment, the horizontal surfaces 932, 933 of the first ink retaining members 923, 924 are respectively held in contact with the upper surface 921*b* of the ink-receiving plate member 921, and the vertical surfaces 930, 931 thereof are respectively held in contact with the respective end surfaces 921*c*, 922*c* of the ink-receiving plate member 921 and the pendent member 922. Therefore, the first ink retaining members 923, 924 can smoothly receive the waste ink from the ink-receiving plate member 921. The four ink absorbing blocks (the ink-receiving plate member 921, the pendent member 922 and the two ink retaining members 923, 924) may be formed integrally with each other. In the present embodiment, however, the four ink absorbing blocks are formed independent of each other, leading to decrease a manufacturing cost of the MFD 1, while maintaining a good performance to retain the waste ink.

Further, in the MFD 1, the waste ink ejected by the recording head 39 when the flushing operation is performed is first received by the first porous member 800 and then the second porous member 802. The received waste ink permeates through the first and second porous members 800, 802 to the ink-receiving plate member 921. Thus, splashes and/or mists of the waste ink ejected by the recording head 39 are prevented from being spread. Therefore, the platen 42 and the recording head 39 are prevented from being stained by the splashes and the mists, leading to maintain a good quality of images recorded on a recording sheet. The ink-receiving member 921 as one of the ink absorbing blocks has nap on a surface thereof and when the nap of the ink-receiving member 921 contacts the recording head 39, the nap may cause an adverse influence on the recording head 39. In the present embodiment, the first porous member 800 and the second porous member 802 are located between the recording head 39 and the ink-receiving member 921 in the vertical direction, so that the recording head 39 is prevented from being adversely affected by the nap of the ink-receiving member 921.

It is to be understood that the present invention may be embodied with various changes, modifications, and improvements that may occur to a person skilled in the art without departing from the spirit and scope of the invention defined in the appended claims. For example, the waste-ink retaining portion 900 may have a different structure from that of the present embodiment, and the ink retaining member of the waste-ink retaining portion 900 may be formed as a single integral body. At least the two first ink retaining members 923, 924 of the four ink absorbing blocks may be replaced by an ink absorbing material which is amorphous and which expands after absorbing the waste ink. The first inner space 914 of the ink-retaining-member supporting portion 913 accommodates the ink absorbing material with a clearance left therein in an initial state in which the waste ink has not been absorbed by the ink absorbing material, and accommodates the ink absorbing material with substantially no clearance left therein in a terminal state in which the waste ink has been absorbed by the ink absorbing material to a permissible upper limit. In this embodiment, the ink-retaining-member supporting portion 913, as a casing which limits an expanding range of the amorphous ink absorbing material, extends upward such that a top end thereof is positioned higher than a height position of the ink-receiving member 921. Thus, the present invention encompasses an embodiment in which an ink retaining material extends upward such that a top end thereof is positioned higher than a height position of the ink receiving portion (i.e., ink-receiving member 921) at least when the ink retaining material expands after absorbing the waste ink to the permissible upper limit.

Figure 13:
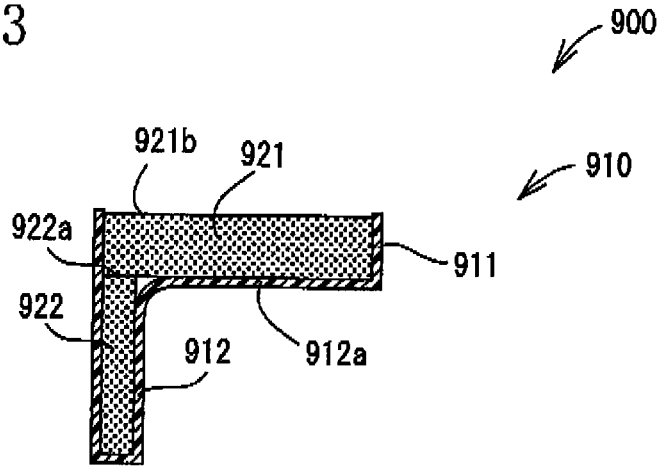
FIG. 13 is an illustrative cross-sectional view schematically showing a structure of a portion of the waste-ink retaining device.
Figure 14:
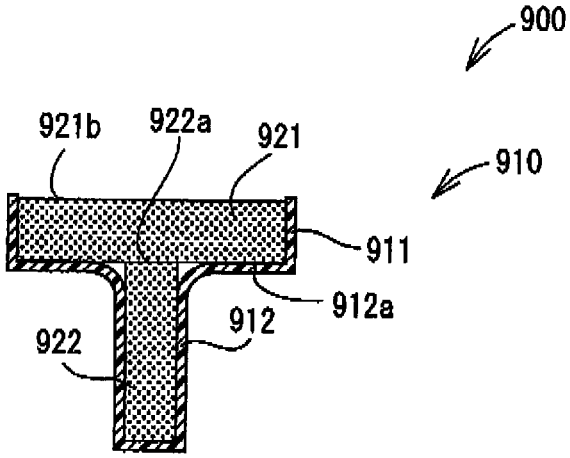
FIG. 14 is an illustrative cross-sectional view schematically showing a structure of a portion of another waste-ink retaining device of another MFD as a second embodiment of the present invention.

In the illustrated embodiment, the upper surface 922*a* of the pendent member 922 is held in contact with a left-hand end portion of the lower surface 921*a* of the ink-receiving plate member 921 as seen in FIG. 13. The present invention is not limited to that embodiment. For example, the upper surface 922*a* of the pendent member 922 may be held in contact with a middle portion of the lower surface 921*a* of the ink-receiving plate member 921, as shown in FIG. 14.

What is claimed is:

1. An inkjet printer, comprising:

a recording head configured to eject an ink droplet and to be moved in a first direction by a carriage;

a platen comprising a horizontal area disposed below the recording head;

a waste-ink receiving member disposed below the recording head and within the horizontal area of the platen that is configured to receive waste ink from the recording head, the waste-ink receiving member comprising at least one porous member through which the waste ink permeates;

a waste-ink retaining member disposed horizontally adjacent to the platen in a second direction that is perpendicular to the first direction, the waste-ink retaining member comprising at least one ink absorbing member, and the waste-ink retaining member being configured to retain the waste ink received by the waste-ink receiving member and to extend upward at least to a horizontal plane in which the horizontal area of the platen lies; and a waste-ink transmitting member extending horizontally between the waste-ink receiving member and the waste-ink retaining member that is configured to transmit the waste ink from the waste-ink receiving member to the waste-ink retaining member, the waste-ink transmitting member comprising:

at least one ink absorbing member, a first portion disposed below the platen and below the waste-ink receiving member that comprises an upper surface configured to receive the waste ink from the waste-ink receiving member, a second portion disposed horizontally adjacent to the waste-ink receiving member and the platen in the second direction, the second portion comprising an upper surface disposed horizontally adjacent to the waste-ink receiving member and the platen, and a third portion disposed horizontally adjacent to the platen in the second direction but below the waste-ink retaining member, the third portion comprising an upper surface configured to transmit the waste ink to the waste-ink retaining member by being held in contact with the lower surface of the waste-ink retaining member, wherein the waste-ink receiving member, the waste-ink transmitting member, and the waste-ink retaining member are formed independently one another.

2. The ink jet printer according to claim 1, wherein:

the waste-ink retaining member further comprises a vertical surface;

the waste-ink transmitting member further comprises an end surface; and the vertical surface and the end surface are held in contact with each other.

* * * * *